US008068615B2

(12) United States Patent
Jakowski

(10) Patent No.: US 8,068,615 B2
(45) Date of Patent: Nov. 29, 2011

(54) AUTOMATIC TRANSFORMER SATURATION COMPENSATION CIRCUIT

(75) Inventor: Steven J. Jakowski, Lakeville, MN (US)

(73) Assignee: Bosch Security Systems, Inc., Fairport, NY (US)

( * ) Notice: Subject to any disclaimer, the term of this patent is extended or adjusted under 35 U.S.C. 154(b) by 1279 days.

(21) Appl. No.: 11/431,063

(22) Filed: May 9, 2006

(65) Prior Publication Data

US 2007/0263883 A1 Nov. 15, 2007

(51) Int. Cl.
*H04R 29/00* (2006.01)

(52) U.S. Cl. ..... 381/59

(58) Field of Classification Search ..... 381/103, 381/104, 107, 110, 123, 58, 59, 28, 323, 381/98, 99, 109, 386; 330/70, 71; 84/705
See application file for complete search history.

(56) References Cited

U.S. PATENT DOCUMENTS

| | | | | | |
|---|---|---|---|---|---|
| 2,487,135 | A | * | 11/1949 | Herrnfeld | 367/135 |
| 2,710,313 | A | * | 6/1955 | Logan | 381/120 |
| 3,056,327 | A | * | 10/1962 | Schwartz et al. | 84/705 |
| 3,153,120 | A | * | 10/1964 | Brown | 381/27 |
| 3,247,321 | A | * | 4/1966 | Way | 381/1 |
| 3,332,076 | A | * | 7/1967 | Burson, Jr. | 340/384.71 |
| 3,714,548 | A | | 1/1973 | Macrander | |
| 4,021,614 | A | | 5/1977 | Bubbers | |
| 4,204,096 | A | * | 5/1980 | Barcus et al. | 381/348 |
| 4,255,782 | A | | 3/1981 | Joyce | |
| 4,256,923 | A | | 3/1981 | Meyers | |
| 4,323,736 | A | | 4/1982 | Strickland | |
| 4,461,931 | A | | 7/1984 | Peters | |
| 4,607,142 | A | | 8/1986 | Martin | |
| 4,646,083 | A | | 2/1987 | Woods | |
| 4,775,766 | A | | 10/1988 | Kooy et al. | |
| 4,896,093 | A | | 1/1990 | Spires | |
| 5,150,270 | A | | 9/1992 | Ernst et al. | |
| 5,369,355 | A | | 11/1994 | Roe | |
| 5,509,080 | A | | 4/1996 | Roberts | |
| 6,121,732 | A | | 9/2000 | Parker | |
| 6,766,026 | B2 | | 7/2004 | Caldwell | |
| 6,842,527 | B2 | | 1/2005 | Caldwell | |
| 2006/0012424 | A1 | | 1/2006 | Peavey et al. | |
| 2006/0013406 | A1 | | 1/2006 | Risch et al. | |

* cited by examiner

*Primary Examiner* — Xu Mei
*Assistant Examiner* — Lao Lun-See
(74) *Attorney, Agent, or Firm* — Fredrikson & Byron, P.A.

(57) ABSTRACT

A transformer saturation compensation circuit for loudspeakers in embodiments of the invention may include one or more of the following features: (a) a transformer with a primary winding and a secondary winding electrically coupled to an output, (b) a high pass filter, (c) a current dependent resistive load electrically coupled in parallel with the capacitor and electrically coupled to an input, (d) a switch located at the primary winding electrically coupled to the capacitor and the resistive load, the switch being rotatable to each of the taps, where the current dependent resistive load provides saturation compensation for different loudspeaker configurations without requiring changes to a highpass filter cutoff frequency, and (e) a resistive load electrically coupled in parallel with the current dependent resistive load and the capacitor.

23 Claims, 8 Drawing Sheets

AUTOMATIC TRANSFORMER SATURATION COMPENSATION CIRCUIT

FIELD

This invention relates to audio circuits employing a transformer. Particularly, this invention relates to using a current actuated high pass filter to minimize the adverse effects of transformer saturation on the driving amplifier in a high voltage distributed line audio system. More particularly, this invention relates to using a current actuated high pass filter circuit to automatically insert a high pass filter into the signal path of a transformer equipped loudspeaker in order to compensate for the effects of transformer saturation without affecting overall average midband and high frequency (e.g. vocal) level.

BACKGROUND

The use of transformers in electrical systems is well known in the art. Transformers are commonly used to provide galvanic isolation for wires carrying signals over substantial lengths, such as wires delivering audio input to loudspeakers. The frequency range over which a conventional transformer is capable of providing linear, distortionless, and un-attenuated signal transfer, however, is limited by the magnetic saturation of the transformer's core. Saturation occurs when a transformer is driven to induce a net flux density higher than its core can support. It is known from transformer theory that flux density is proportional to the ratio of winding current to frequency. Thus a transformer will tend to saturate at higher currents and lower frequencies.

As a high voltage distributed line audio transformer approaches saturation at low frequencies, its impedance decreases rapidly causing an abrupt increase in current draw which can cause the driving amplifier to go into a self-protection mode or fail. A small number of transformers nearing saturation may not pose a problem to a large, well designed amplifier, but as the number of transformers on a given line increases, their combined impedance drop near saturation may appear as a dead short to the amplifier, causing said amplifier to interrupt the program in an effort to prevent its own destruction. Good system design dictates that a high pass filter be inserted into the signal chain at the amplifier input for the purpose of filtering out those low frequencies likely to cause a problem. Presently, the accepted practice when increasing the number of transformer equipped loudspeakers on a high voltage distributed line is to raise the high pass filter frequency to a point that will not allow any frequencies capable of causing transformer saturation to be passed down the line. (E.g., instead of a 50 Hz hi-pass that may be suitable for one or two speakers, a large number of the same speakers may require a hi-pass frequency of 100 Hz or higher to protect the amplifier from the combined effects of transformer saturation.) This increase in hi-pass filter frequency greatly reduces low frequency response and causes music to sound "thin" or "tinny," which may not be a problem in voice-only applications but is unacceptable in systems designed primarily for music.

In audio applications, for instance, the limitations attributable to core saturation are particularly apparent in the performance of commercially available small transformers at lower frequencies. One known alternative for improved low frequency performance is to use a larger transformer. In applications where space is at a premium, such an alternative is often not a viable one. Moreover, larger transformers are heavier and costlier.

Another alternative is to avoid transformer coupling altogether. Transformerless systems, however, lack the advantages of transformers in large distributed systems such as independent level adjustment of each loudspeaker and the ability to operate at high voltages and proportionally lower line currents thereby reducing line losses and wire size requirements. They are also limited in the number of loudspeakers that may be driven on a single line due to the combined impedance of the loudspeaker load quickly dropping below what a commercially available amplifier is capable of driving. For this reason alone, driving more than four loudspeakers on the same line without transformers is impractical at best.

SUMMARY

A transformer saturation compensation circuit for loudspeakers in embodiments of the invention may include one or more of the following features: (a) a transformer with a primary winding and a secondary winding electrically coupled to an output, (b) a high pass filter, (c) a current dependent resistive load electrically coupled in parallel with the capacitor and electrically coupled to an input, (d) a switch located at the primary winding electrically coupled to the capacitor and the resistive load, the switch being rotatable to each of the taps, where the current dependent resistive load provides saturation compensation for different loudspeaker configurations without requiring changes to a highpass filter cutoff frequency, and (e) a resistive load electrically coupled in parallel with the current dependent resistive load and the capacitor.

A transformer saturation compensation circuit for loudspeakers in embodiments of the invention may include one or more of the following features: (a) a transformer with a primary winding having multiple taps and a secondary winding electrically coupled to an output, (b) a high pass filter, (c) a current dependent resistive load electrically coupled in parallel with the high pass filter and electrically coupled to an input, and (d) a switch located at the primary winding electrically coupled to the high pass filter and the resistive load, the switch being rotatable to each of the taps, where the current dependent resistive load provides saturation compensation for different loudspeaker configurations without requiring changes to a highpass filter cutoff frequency in a transformer mode, the switch also being rotatable to bypass the transformer through the current dependent resistive load to the output when the loudspeaker in an eight ohm mode.

A loudspeaker having a transformer saturation compensation circuit in embodiments of the invention may include one or more of the following features: (a) a housing, (b) a contact on the housing to receive an incoming audio signal, (c) a transformer with a primary winding and a secondary winding electrically coupled to a speaker, (d) a high pass filter, (e) a current dependent resistive load electrically coupled in parallel with the high pass filter and electrically coupled to the incoming audio signal, the current dependent resistive load provides transformer saturation compensation without requiring the elimination of low frequency audio signals, (f) at least two taps on the primary transformer winding each tap being a different loudspeaker configuration based upon a power level of the incoming audio signal, (g) a switch located at the primary winding electrically coupled to the high pass filter and the resistive load, the switch being rotatable to each of the taps, where the current dependent resistive load provides saturation compensation for different loudspeaker configurations without requiring changes to a highpass filter cutoff frequency, (h) a resistive load electrically coupled in parallel with the current dependent resistive load and the high pass filter.

DRAWINGS

DESCRIPTION OF VARIOUS EMBODIMENTS

Figure 1:
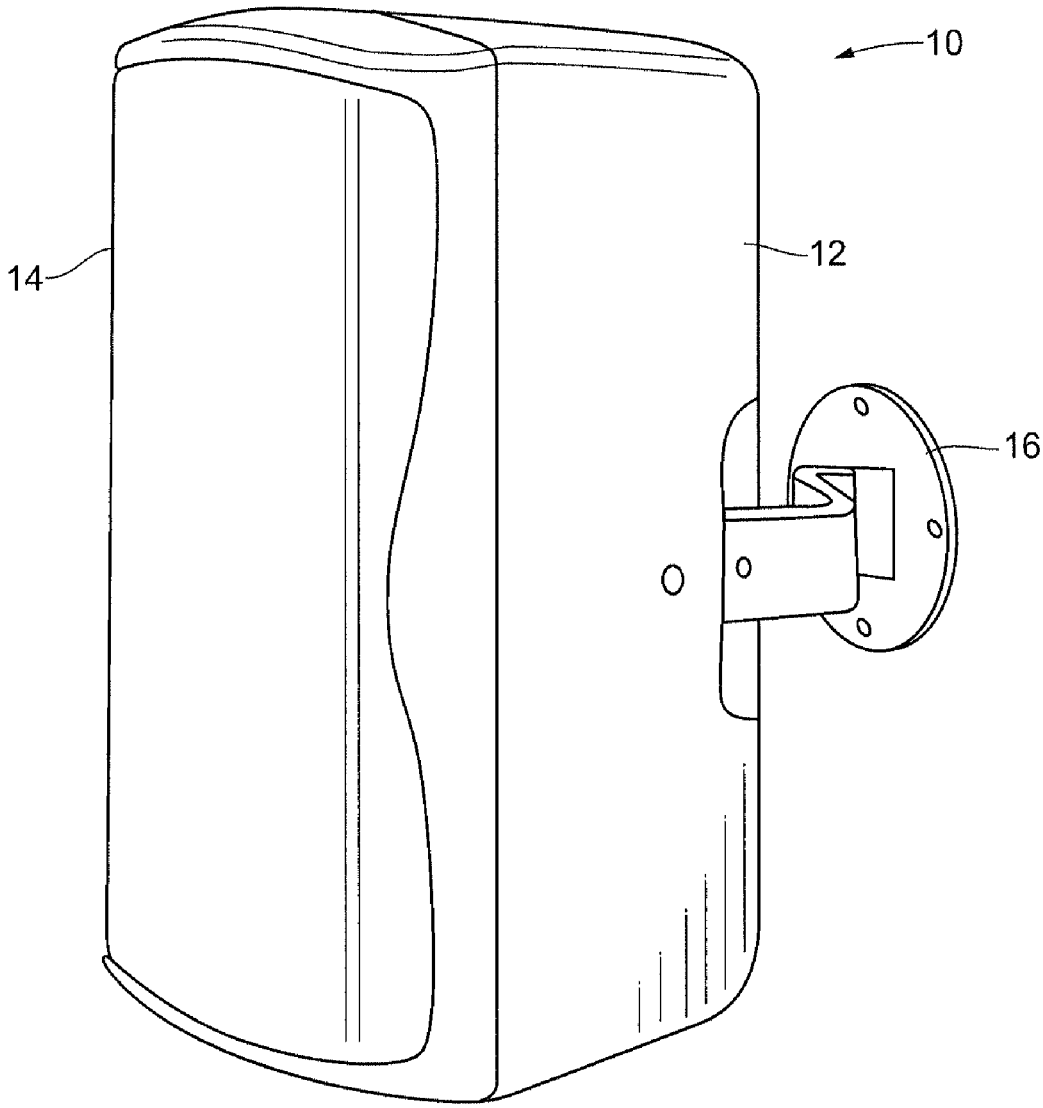
FIG. 1 shows a general loudspeaker structure in an embodiment of the present invention.

The following discussion is presented to enable a person skilled in the art to make and use embodiments of the invention. Various modifications to the illustrated embodiments will be readily apparent to those skilled in the art, and the generic principles herein may be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention. The following introductory material is intended to familiarize the reader with the general nature and some of the features of embodiments of the invention.

With reference to FIG. 1, a general loudspeaker structure in an embodiment of the present invention is shown. Loudspeaker (10) can have a housing (12), a grill (14), and an arm mount (16). Housing (10) can be a molded high impact polystyrene, however, most any other material including other polymers can be used without departing from the spirit of the invention. Grill (14) can be multi-layered, zinc plated, and powder coated for corrosion resistance. Grill (14) can be equipped with both hydrophobic cloth and acoustic foam to provide weatherized protection for use of loudspeaker (10) indoors and out. Arm mount (16) can be used to removably mount loudspeaker (10) to most any location. Arm mount (16) can be made of cast aluminum to provide a strong connection to the mount location; however, arm mount (16) can be made from most any material including plastic or wood without departing from the spirit of the invention. Housing (12) houses the internal componentry of loudspeaker (10) which is discussed in more detail below. The internal circuitry (40) includes a dividing network (crossover) and a protection circuit (44) (FIG. 3) that when in 8 ohm mode functions as a full-range current limiter. In a transformer mode, circuit (44) is reconfigured by selector switch (22) into a current actuated highpass filter at the transformer primary 74 (FIG. 6), as will be discussed in more detail below. When operating in a transformer mode with circuit (44) configured as the Automatic Saturation Compensation circuit, circuit (44) gently rolls off the lowest frequencies during periods of excessive low frequency drive level thus limiting the current through transformer (46) through the transformer saturation region to maintain a safe load on the amplifier without affecting the higher (e.g. vocal) frequencies. The Automatic Saturation Compensation circuit allows for any number of speakers to be run on the same distributed line with the same highpass filter setting as for a single loudspeaker as long as the total number of tapped watts on the line does not exceed the amplifier's wattage rating. The net result is that all speakers in a large high voltage distributed sound system can have the same overall sound quality as a single loudspeaker of the same type operating transformerless (e.g. at 8 ohms), except during periods of excessive low frequency drive at high level, during which time only the lowest frequencies will experience a drop in level while the midband levels remain essentially unchanged.

Figure 2A:
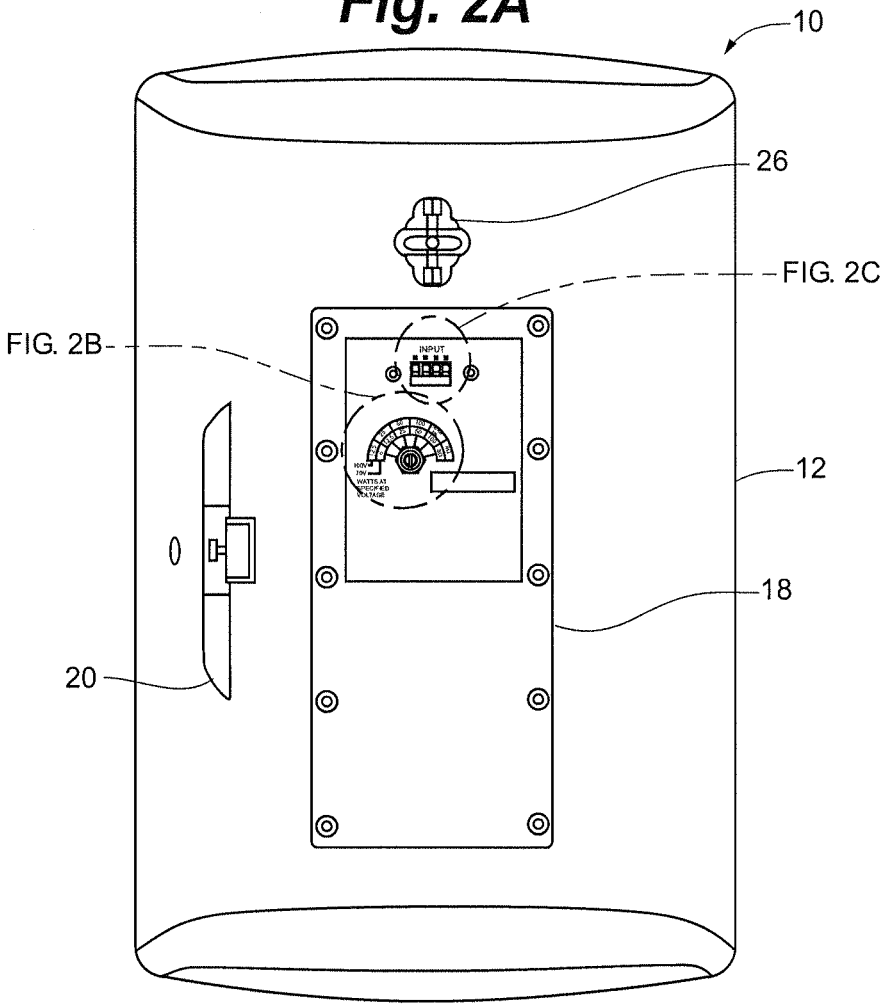
FIG. 2A shows a rear profile view of a loudspeaker in an embodiment of the present invention.
Figure 2B:
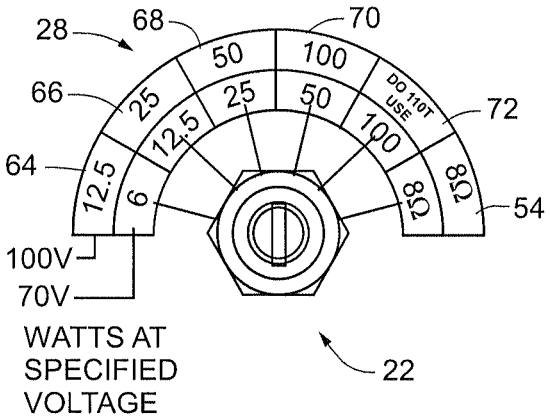
FIG. 2B shows a wattage tap selector switch in an embodiment of the present invention.
Figure 2C:
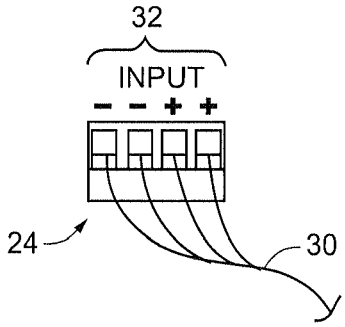
FIG. 2C shows a line connector in an embodiment of the present invention.

With reference to FIG. 2A, a rear profile view of a loudspeaker in an embodiment of the present invention is shown. At the rear of housing (12), loudspeaker (10) can have an input panel (18), an arm mount attachment bracket (20), and an eye bolt (26). Eye bolt (26) can be used for connection to a seismic restraint to prevent theft of loudspeaker (10). An installer would connect it to a properly rated hardware fitting that is securely installed independently of bracket (16). Bracket (20) is used to receive arm mount (16). Arm mount (16) can be held in place with a socket head bolt, however, other methods of attaching arm mount (16) to housing (12) are fully contemplated including snap fitting, gluing, and riveting without departing from the spirit of the invention.

Input panel (18) houses wattage tap selector switch (22) and connector (24). Before attaching loudspeaker (10) to bracket (16), an installer would select the proper wattage tap setting for the installation. This selection would be dependant on the line voltage and the amount of power (watts) intended for that particular loudspeaker (10) as determined by the installation system design. In the present invention the power taps (64-72) are 100, 50, 25, and 12.5 watts respectively at both 70.7 volts and 100 volts with a 6 watt tap for 70.7 volts only. However, other power tap ratings are fully contemplated without departing from the spirit of the invention. There is also an 8 ohm bypass setting (54) which will be discussed in more detail below. Taps (54) and (64-72) are selected by wattage tap selector switch (22) which is a rotary switch on Input panel (18). Other operating voltages and means of selecting transformer taps are fully contemplated without departing from the spirit of the invention. A guide (28) on the back of each loudspeaker (10) shows which switch position to use for the desired power settings at either 70.7 volts or 100 volts.

An installer can connect loudspeaker (10) to an amplifier output with wires (30) using connector (24). Connector (24) could be a detachable four pole phoenix type connector, however, connector (24) could be most any electrical connector without departing from the spirit of the invention. In the present invention, the four connections (32) allow for a convenient loop through wiring to the next speaker system wired on that line. This connection method allows an installer to parallel all systems on the line in a way that allows for the disconnection of any one system without disabling the others or wiring them so that unplugging one would disable all others wired downstream of the one that was unplugged.

Figure 3:
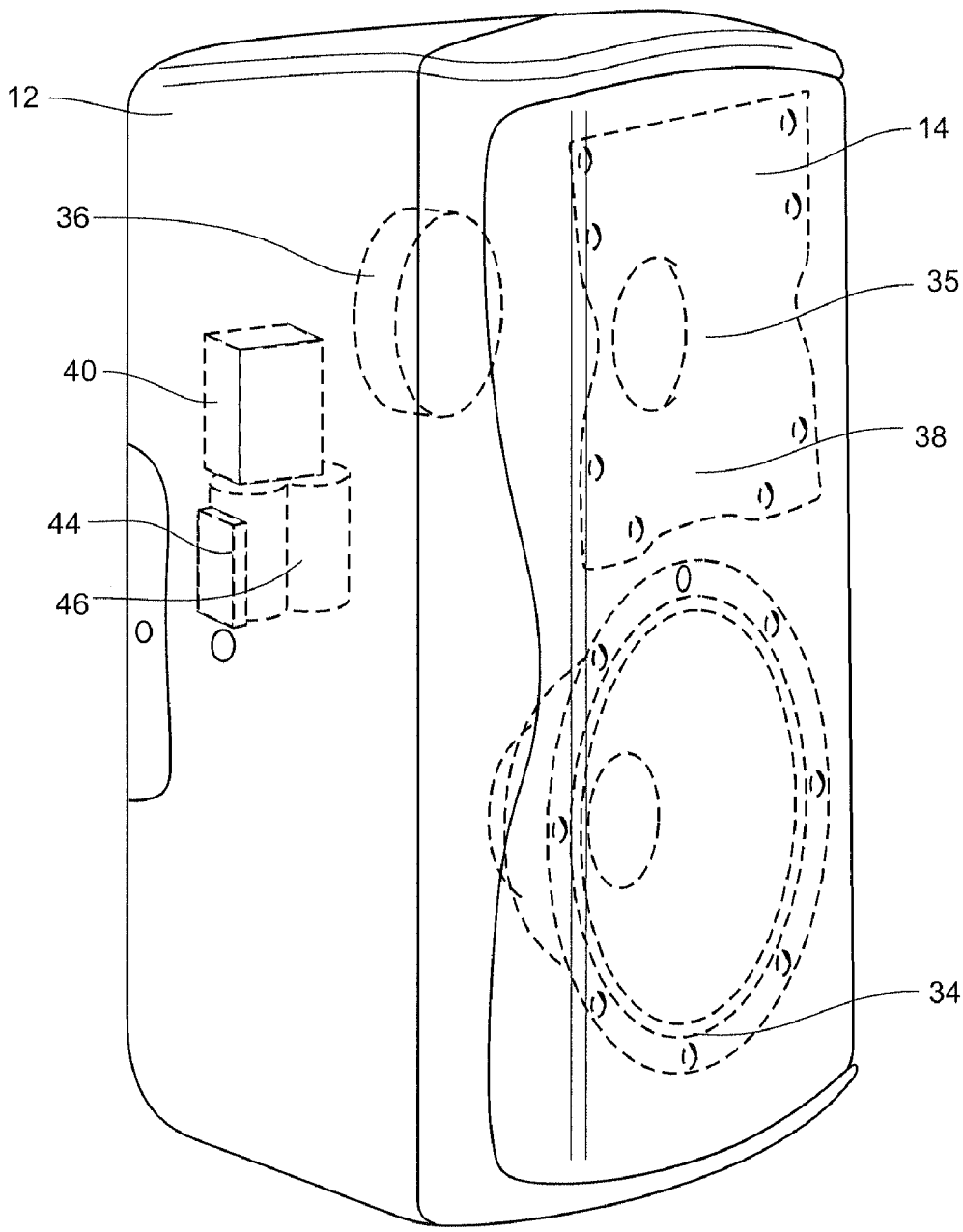
FIG. 3 shows a transparent axonometric view of a loudspeaker in an embodiment of the present invention.

With reference FIG. 3, a transparent axonometric view of a loudspeaker in an embodiment of the present invention is shown. Loudspeaker (10) can have housing (12), a grill (14), compression driver (36), rotatable wave guide (38), speaker (34), crossover network (40), overload protection circuitry (44) and transformer (46). Speaker (34) can be most any size or type of transducer but for the purposes of this disclosure speaker (34) is an 8 inch woofer. Speaker (34) can be used for low frequency reproduction. Compression driver (36) can be a specialized mid or high frequency transducer. Rotatable wave guide (38) allows for the high frequency coverage pattern to be oriented either vertically or horizontally. Crossover network (40) is a low loss high efficiency network which divides the audio spectrum into low and high frequency bands for the respective transducers. Transformer (46) could also drive one or more full range transducers of any type directly without need for a dividing network. Protection circuit (44), when configured by input selector switch (22) for 8 ohm operation, limits the overall input power during overload conditions so as not to damage loudspeaker (10). When protection circuit (44) is configured by input selector switch (22) for transformer operation, the driving amplifier is protected from the adverse effects of transformer saturation during periods of excessive low frequency drive level.

Figure 4:
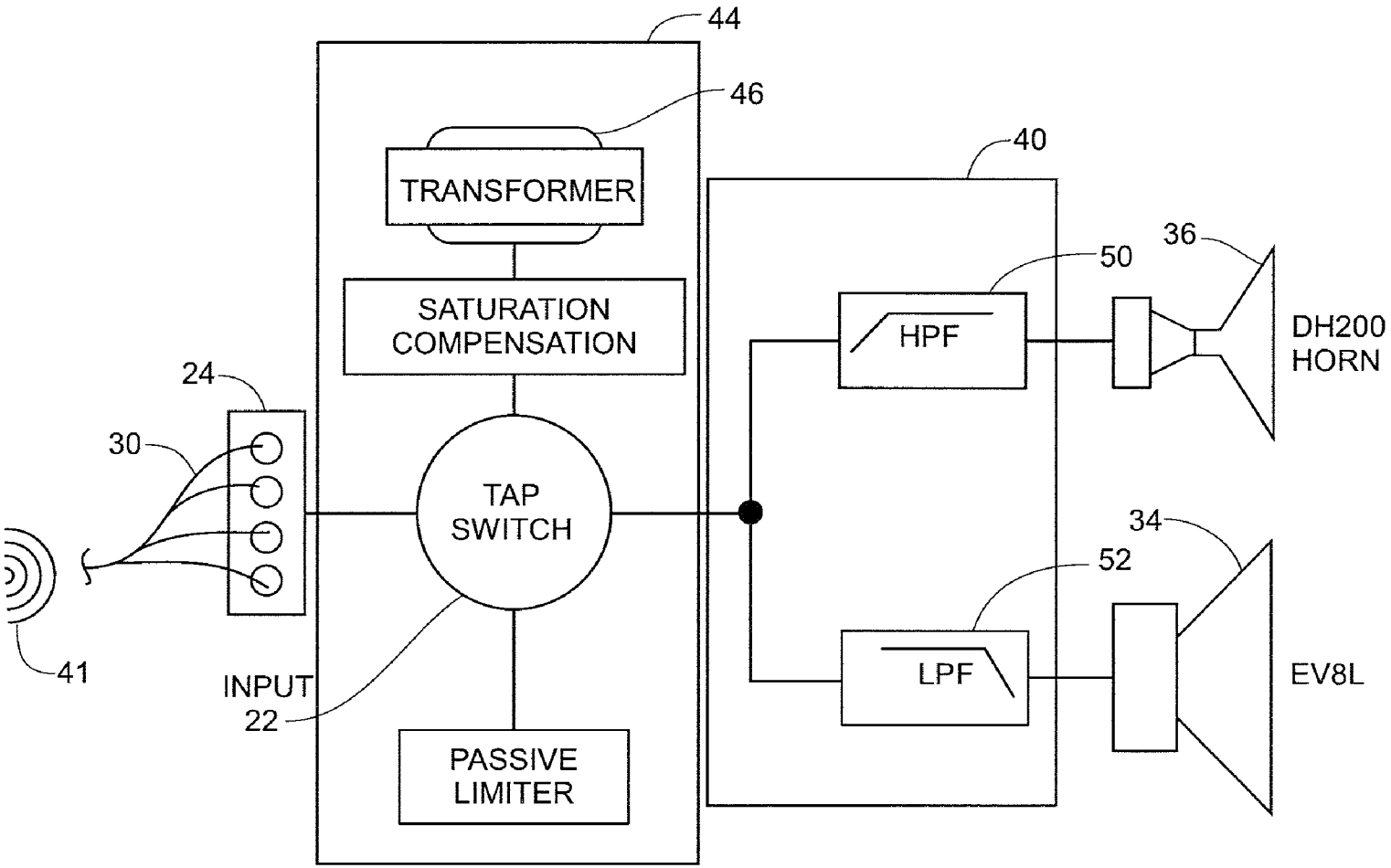
FIG. 4 shows a block diagram of internal circuitry of a loudspeaker in an embodiment of the present invention.

With reference to FIG. 4, a block diagram of internal circuitry of a loudspeaker in an embodiment of the present invention is shown. An audio input (41) is typically received at connector pin (24) through wires (30) from an amplifier driving loudspeaker (10). In the 8 ohm mode, input signal (41) is first routed to protection circuitry (44) configured as a full-range current limiter by selector switch (22) to assure signal (41) is not destructive to loudspeaker (10) in the event the drive level becomes excessive. In transformer mode protection circuitry (44) is configured by selector switch (22) as a current actuated high pass filter ahead of the transformer primary to assure the amplifier is protected from the effects of low frequency transformer saturation in the event signal 41 contains excessive low frequency energy.

Figure 5:
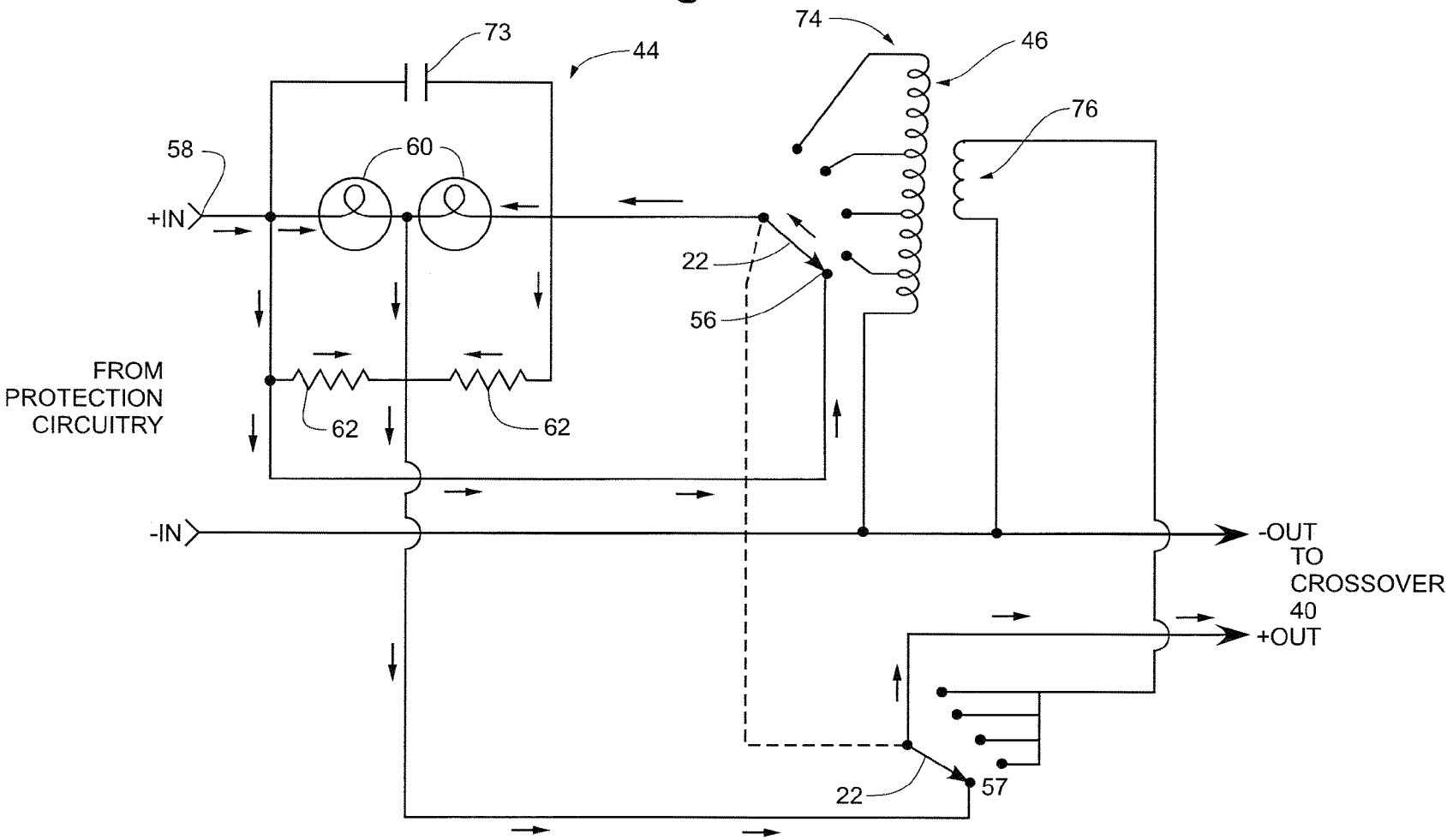
FIG. 5 shows the internal protection circuitry (44) configured as a basic full-range current limiter for the 8 ohm mode in an embodiment of the present invention.

With reference to FIG. 5, protection circuit (44) in the 8 ohm mode in an embodiment of the present invention is shown. In the 8 ohm mode, transformer (46) is bypassed by turning selector switch (22) to 8 ohm mode (54) (FIG. 2A). This action causes switch (22) to connect with contact (56) thus bypassing the primary (74) of transformer (46). This same contact also disables (shorts) high pass capacitor/filter (73) and parallels incandescent lamps (60) and resistors (62) causing protection circuit (44) to be configured as a standard full-range current limiter. The output of protection circuit (44) is then routed through contact (57) which bypasses the secondary winding (76) of transformer (46) and sends the now current limited full range signal to the appropriate transducers via crossover network (40). Therefore, as audio input signal (41) arrives at connection (58), audio input signal (41) is routed via the arrows shown through circuit (44). It is noted that in the 8 ohm mode only, while the transformer is bypassed, components of circuit (44) act as a standard current limiter which limits the amount of current that can be drawn through circuit (44). Input signal (41) would travel through incandescent bulbs (60) and through resistors (62) and then out to crossover (40) where signal (41) would be divided and sent to transducers (34) and (36).

Figure 6:
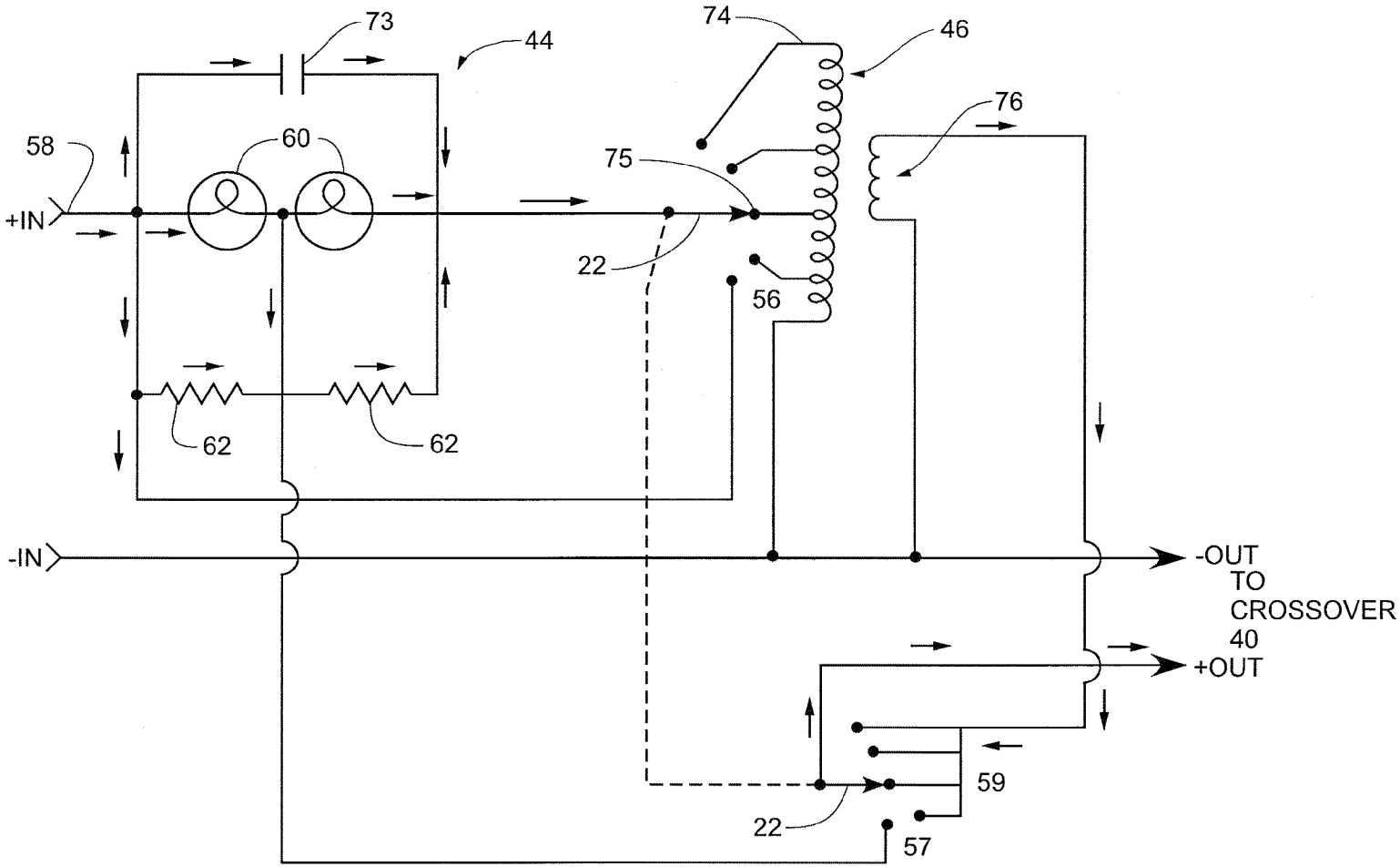
FIG. 6 shows the internal protection circuitry configured for Automatic Saturation Compensation in transformer mode in an embodiment of the present invention.

With reference to FIG. 6, a saturation compensation circuit in a transformer mode in an embodiment of the present invention is shown. In transformer mode, switch (22) could be changed to any one of transformer mode settings (64) through (72) as shown in FIG. 2A. In FIG. 6, switch (22) has been turned to position (70) (100 watts at 100 volts) connecting protection circuit (44) with the appropriate transformer tap at switch contact (75). This same switch position also connects the input of crossover (40) to the secondary (76) of transformer (46) at switch contact (59). Circuit (44) is now configured as a current actuated high pass filter for automatic saturation compensation. Input signal (41) will come in at connection (58). Under normal operating conditions (e.g. nominal drive level with no excessive low frequency content) series connected incandescent lamps (60), having an incandescing current threshold rating that compliments the transformer full load operating current rating, will have a total cold filament resistance of approximately one ohm. This series resistance has a negligible effect on the transformer operating characteristics and is, in effect, inaudible. However, in the event input signal (41) contains enough high level low frequency content to induce saturation in transformer (46), the current draw of primary winding (74) will increase abruptly in the saturation region. When this happens the increased current flow through lamps (60) will cause them to incandesce, thus immediately increasing their effective resistance in series with primary winding (74). This increased resistance immediately causes a reduction in current flow through primary winding (74) which may be enough to cool the filaments of lamps (60) causing current flow to return to previous levels resulting in transformer (46) saturating again. Shunt resistors (62) help stabilize this "pumping" action but may or may not be necessary depending on the filament characteristics of lamps (60) and the current draw characteristics at saturation of transformer (46). Lamp (60) and resistor (62) form the basis of a simple full-range current limiter. As such, the entire audio program would be reduced in level proportionate to the degree of excess current drawn when transformer (46) saturates. This could effectively cause a temporary reduction or even cessation of audio program to transducers (34) and (36) whenever and for as long as the transformer is in saturation as most of the program signal (41) would be dissipated by the lamps (60) and resistors (62). As transformer saturation typically happens only at low frequencies, the severe impedance drop at full power load that causes abnormally high current draw is only seen at the lower end of the audio spectrum. While the current limiter circuit is reacting to this impedance drop and limiting the amount of current drawn at low frequencies, high pass capacitor (73) continues to pass mid and upper frequencies to the transformer in a frequency range that is still operating at a normal impedance. The component value of capacitor (73), typically in microfarads, is determined by evaluation of the transformer saturation characteristics, the system impedance of the actual loudspeaker system itself and the sonic characteristics desired for the given application. In the embodiment of the present invention, the sonic characteristics are such that transformer saturation causes only a temporary lessening of bass response with little or no change in the apparent overall level of the audio program.

In transformer mode (64) through (72), circuit (44) reconfigures itself to a current actuated highpass filter from a simple current limiter. As transformer (46) approaches saturation at low frequencies, its impedance decreases rapidly causing an abrupt increase in current draw which can cause the amplifier to either go into its own protect mode or fail. As discussed above, this is the reason why current loudspeaker products usually require the highpass filter frequency to be increased as the number of systems sharing the line increases. Instead of (e.g.) a 50 Hz highpass, which is desirable, the same speakers may now require a 100 Hz highpass just to protect the amplifier from the combined effects of the transformer saturation.

Figure 8:
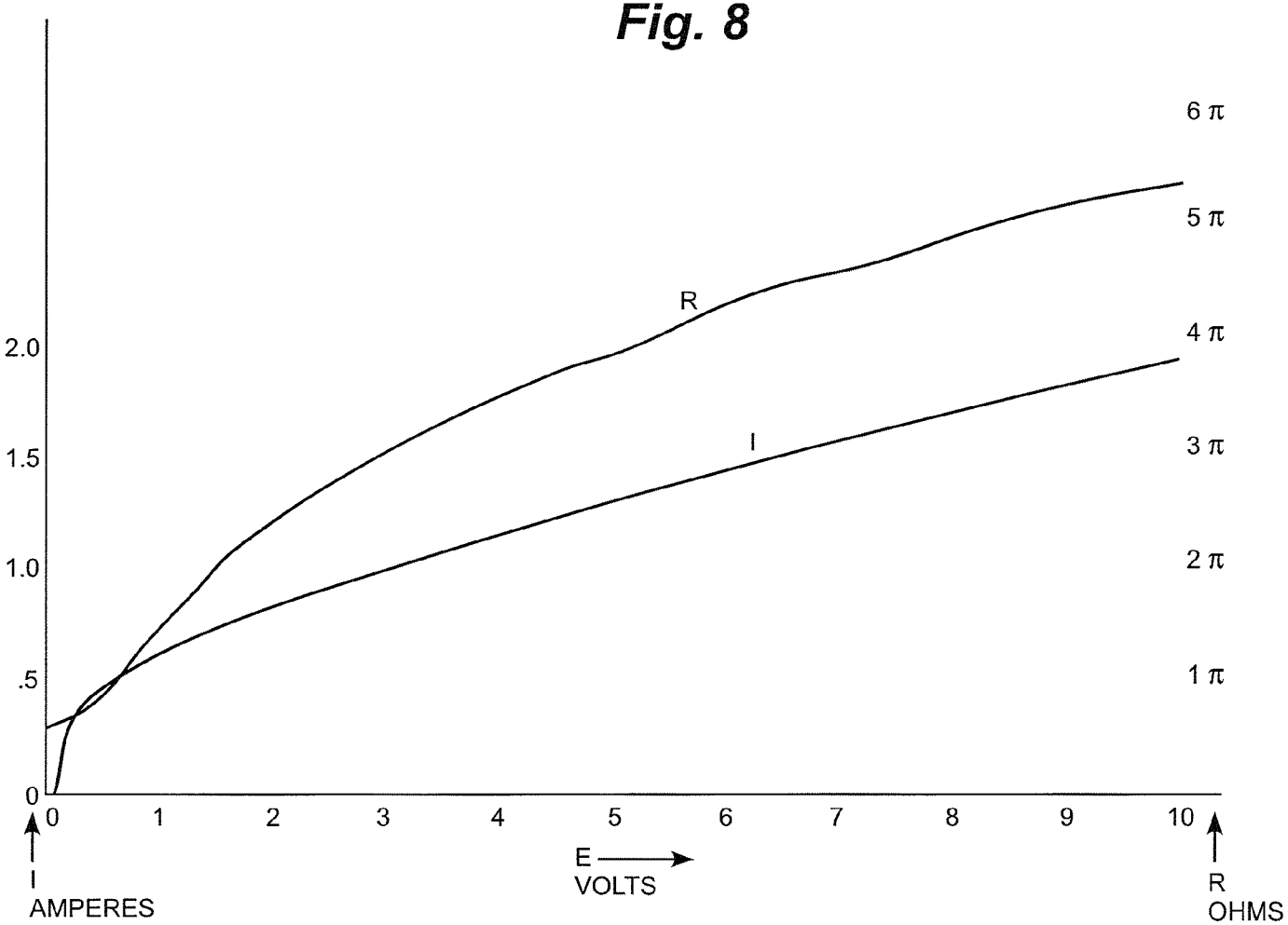
FIG. 8 shows a chart showing resistance versus current for incandescent bulbs in an embodiment of the present invention.

With reference to FIG. 8, a chart showing resistance versus current for incandescent lamps in an embodiment of the present invention, note the point where the two curves overlap. This "knee" is the threshold of incandescence of the lamp. The cold filament has a very low resistance, but once lit the resistance of the filament rises rapidly. The corresponding current through the filament increases at a fairly linear rate once incandescence takes place. Different lamps with different characteristics could be selected to achieve desired results with different transformers for different performance criteria.

Figure 7:
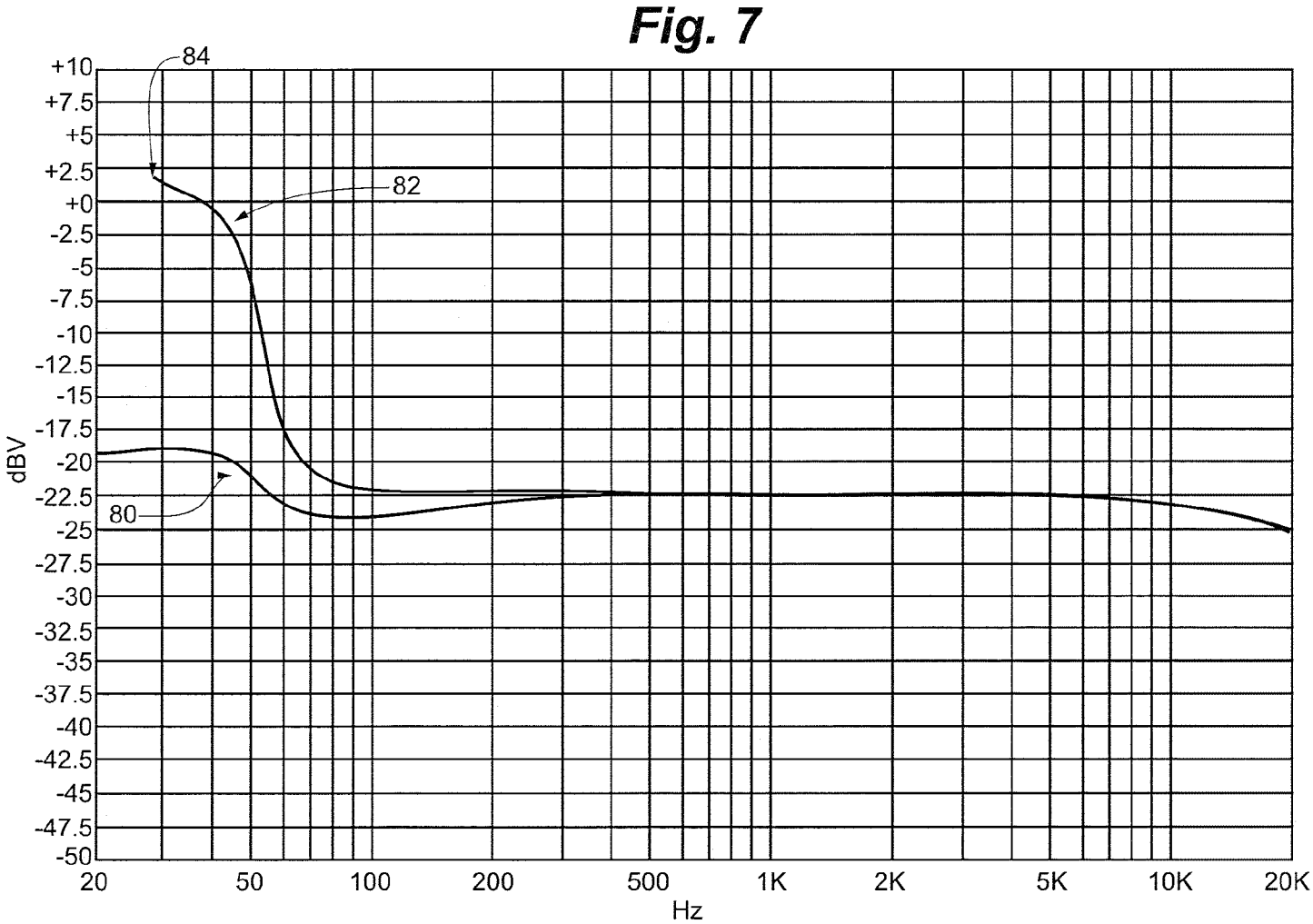
FIG. 7 shows the full load current draw versus frequency of a typical inexpensive 60 watt 70 volt line transformer with and without the Automatic Saturation Compensation circuit.

With reference to FIG. 7, a current draw graph of a typical inexpensive 60 watt 70 volt audio line transformer is shown. Curve (82) represents the present state of transformer equipped loudspeaker technology and curve (80) represents a loudspeaker transformer with an automatic saturation compensation circuit. Measurements were done with 70 volts applied to the transformer-primary and the secondary terminated in an 8 ohm resistive load for the sake of measurement linearity. Current flow through the transformer primary was measured by a wide range laboratory current loop, the output of which was charted as dBv because the only measurement of interest for this illustration was the delta of the two curves. As shown by curve (82), current flow through the primary winding began to increase below 100 Hz. As the transformer approached saturation, current draw increased rapidly through the 50 Hz region, leveling off somewhat until the amplifier went into protect mode at approximately 28 Hz (84). Note that this was a single 60 watt transformer being driven by a 1200 watt laboratory amplifier. A typical commercial amplifier would have shut down or self-destructed much sooner. A speaker system using this transformer could require a high pass filter at 60 Hz for one or two units and a high pass filter of up to 100 Hz as more units were added to the line. Curve (80) shows the same test performed on the same transformer with the addition of a current actuated high pass filter configured for automatic saturation compensation operating on the transformer primary. Note that at 50 Hz the current draw is only one dB greater than the current draw at 1 kHz and at no time does it increase more than 3 dB over the 1 kHz midband reference current, which remains essentially unchanged.

Thus, embodiments of the AUTOMATIC TRANSFORMER SATURATION COMPENSATION CIRCUIT are disclosed. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A transformer saturation compensation circuit for loudspeakers comprising: a transformer with a primary winding and a secondary winding electrically coupled to an output, a high pass filter, a current dependent resistive load electrically coupled in parallel with a capacitor and electrically coupled to an input, and a switch located at the primary winding and electrically coupled to the capacitor and the resistive load, the switch being rotatable to each of taps of the primary winding, where the current dependent resistive load provides transformer saturation compensation for different loudspeaker configurations without requiring changes to a highpass filter cutoff frequency, wherein the current dependent resistive load provides cycling intervals of saturation for the transformer.

2. The circuit of claim 1, wherein the current dependent resistive load is at least one incandescent bulb.

3. The circuit of claim 1, further comprising a resistive load electrically coupled in parallel with the current dependent resistive load and the capacitor.

4. The circuit of claim 1, wherein the capacitor shunts high frequencies from the input to the primary transformer winding during transformer saturation.

5. The circuit of claim 4, wherein the high pass filter shunts frequencies above 100 Hz to the primary transformer winding.

6. The circuit of claim 1, wherein the switch is rotated to the selected primary winding transformer tap during the loudspeaker installation.

7. The circuit of claim 5, wherein frequencies below 100 Hz traverse through the current dependent resistive load where the power of the frequencies below 100 Hz is dissipated by the current dependent resistive load.

8. A transformer saturation compensation circuit for loudspeakers comprising: a transformer with a primary winding having multiple taps and a secondary winding electrically coupled to an output, a high pass filter, a current dependent resistive load electrically coupled in parallel with the high pass filter and electrically coupled to an input, and a switch located at the primary winding and electrically coupled to the high pass filter and the resistive load, the switch being rotatable to each of the taps, where the current dependent resistive load provides transformer saturation compensation for different loudspeaker configurations without requiring changes to a highpass filter cutoff frequency in a transformer mode, wherein the current dependent resistive load provides cycling intervals of saturation for the transformer, the switch also being rotatable to bypass the transformer through the current dependent resistive load to the output when the loudspeaker is in an eight ohm mode.

9. The circuit of claim 8, wherein the current dependent resistive load functions as a current limiter in the eight ohm mode.

10. The circuit of claim 9, wherein the eight ohm mode is generally selected for a single loudspeaker on an input line from an amplifier.

11. The circuit of claim 8, wherein the transformer mode is generally selected for multiple loudspeakers on an input line from an amplifier.

12. The circuit of claim 8, wherein all frequencies traverse through the current resistive load when the circuit is in the transformer mode and the transformer is not saturated.

13. The circuit of claim 12, wherein the current resistive load reduces the power at the primary transformer winding during transformer saturation and resumes normal operation when the transformer is no longer saturated.

14. A loudspeaker having a transformer saturation compensation circuit, comprising: a housing; a contact on the housing to receive an incoming audio signal; a transformer with a primary winding and a secondary winding electrically coupled to a speaker, a high pass filter, and a current dependent resistive load electrically coupled in parallel with the high pass filter and electrically coupled between the contact and the primary winding, the current dependent resistive load provides transformer saturation compensation without requiring the elimination of low frequency audio signals, wherein the current dependent resistive load provides cycling intervals of saturation for the transformer.

15. The loudspeaker of claim 14, further comprising at least two taps on the primary transformer winding each tap being a different loudspeaker configuration based upon a power level of the incoming audio signal.

16. The loudspeaker of claim 15, further comprising a switch located at the primary winding electrically coupled to the high pass filter and the resistive load, the switch being rotatable to each of the taps, where the current dependent resistive load provides saturation compensation for different loudspeaker configurations without requiring changes to a highpass filter cutoff frequency.

17. The loudspeaker of claim 14, wherein the current dependent resistive load is at least one incandescent bulb.

18. The loudspeaker of claim 14, further comprising a resistive load electrically coupled in parallel with the current dependent resistive load and the high pass filter.

19. The loudspeaker of claim 14, wherein the high pass filter shunts high frequencies from the input to the primary transformer winding.

20. The loudspeaker of claim 19, wherein the high pass filter shunts frequencies above 100 Hz to the primary transformer winding.

21. The circuit of claim 1, wherein the transformer saturation compensation involves the resistor load providing cycling intervals of saturation for the transformer during periods in which low frequency content on the input results in transformer saturation.

22. The circuit of claim 8, wherein the transformer saturation compensation involves the resistor load providing cycling intervals of saturation for the transformer during periods in which low frequency content on the input results in transformer saturation.

23. The circuit of claim 14, wherein the transformer saturation compensation involves the resistor load providing cycling intervals of saturation for the transformer during periods in which low frequency content in the incoming audio signal results in transformer saturation.

* * * * *